US005509651A

United States Patent [19]

Webster

[11] Patent Number: 5,509,651

[45] Date of Patent: Apr. 23, 1996

[54] CROQUET WICKET AND STAKE SYSTEM FOR ARENAS

[76] Inventor: Richard F. Webster, 514 Swannanoa River Rd., Asheville, N.C. 28805

[21] Appl. No.: 186,804

[22] Filed: Jan. 25, 1994

[51] Int. Cl.[6] ..... A63B 65/10

[52] U.S. Cl. ..... 273/56

[58] Field of Search ..... 273/56

[56] References Cited

U.S. PATENT DOCUMENTS

| | | | |
|---|---|---|---|
| 6,129 | 4/1884 | Brookes | 273/56 |
| 54,848 | 5/1866 | Bradley | 273/56 |
| 620,460 | 2/1899 | Lake . | |
| 838,763 | 12/1906 | Austin et al. . | |
| 2,019,302 | 10/1935 | Gibson | 273/56 |
| 2,657,056 | 10/1953 | Sorteberg | 273/56 |
| 3,464,697 | 9/1969 | Robillard | 273/56 |
| 3,865,375 | 2/1975 | Cosgrove | 273/56 |
| 4,957,290 | 9/1990 | Major | 273/56 |
| 5,158,283 | 10/1992 | Herkness | 273/56 |

FOREIGN PATENT DOCUMENTS

| | | | |
|---|---|---|---|
| 24242 | 10/1909 | United Kingdom | 273/56 |
| 25234 | 11/1909 | United Kingdom | 273/56 |

*Primary Examiner*—Theatrice Brown
*Attorney, Agent, or Firm*—Jospeh T. Guy, Jr.

[57] ABSTRACT

A croquet system for use in an arena is provided wherein a croquet wicket or stake can be attached to a floor. A sleeve is inserted into a void in the floor. The sleeve is capable of receiving a mounting rod which is coaxially attached to either the croquet stake or an upright of a croquet wicket. The croquet wicket or stake can then be inserted for play or removed such that the arena can serve other functions.

13 Claims, 7 Drawing Sheets

CROQUET WICKET AND STAKE SYSTEM FOR ARENAS

FIELD OF THE INVENTION

This invention relates to an improved croquet wicket system which can be easily, and reproducibly, used in an indoor arena. More specifically this invention relates to an improved croquet wicket system which can be quickly removed to allow the arena to be used in alternate ways.

BACKGROUND OF THE INVENTION

Croquet is a rapidly growing sport wherein a multiplicity of players strike a ball with a mallet to systematically traverse a series of wickets and one or more stakes. The rules and game description are well known to those skilled in the art.

The croquet court is characterized by a number of passage wickets and stakes. The passage wickets comprise a pair of co-planar uprights which are substantially perpendicular to the playing surface. The co-planar uprights are joined at one end with a crossmember. The unjoined end of the passage wickets are pressed into the croquet court thereby forming a passage through which the ball must transit in accordance with the proper rules of play. The stakes are typically wooden and are likewise pressed into the croquet court such that they are perpendicular thereto. The stakes form an obstacle with several functions during the course of proper play.

It has recently become of interest to provide croquet wickets and croquet stakes which can be intermittently utilized for croquet. Portable practice wickets are known, as illustrated in U.S. Pat. No. 5,128,283, yet the rearward base ballast is an obstruction and precludes the use of the proper rules of play.

Portable wickets for use on a carpet are provided in U.S. Pat. No, 1,936,220 yet these lack the stability necessary for proper competitive croquet. Furthermore, it is often important to reconstruct a croquet court precisely to allow for record keeping and consistency in league play and the like. The portable wickets of the prior art are not suitable for accurate reconstruction of a particularly preferred arrangement of wickets and stakes. Furthermore, a ball passing in close proximity to the portable prior art wicket may strike the base support and be deflected in a manner which is inconsistent with proper croquet, There has been a long felt need in the art for a croquet wicket system which closely resembles a proper outdoor court without obstructions or a need for rule modifications.

SUMMARY OF THE INVENTION

It is an object of the present invention to provide a mounting system for croquet apparatus which can be intermittently used for arenas, It is another object of the present invention to provide croquet apparatus which can be easily and reproducibly installed and removed form a floor.

It is another object of the present invention to provide a croquet apparatus which can be used without modification of the proper rules of play.

A particular feature of the present invention is the ability to remove the apparatus from the vicinity of play and be able to return them to the identical location.

These and other advantages are provided in a mounting apparatus for a croquet element comprising; a post; a mounting rod coaxially attached to one side of said post; a sleeve capable of receiving said mounting rod; an attachment means for securing said sleeve within a void of a floor; wherein said post is a croquet stake or a wicket upright.

A particularly preferred embodiment is provided in a croquet wicket comprising; a first upright; a second upright; a crossmember connecting said first upright with said second upright; a first mounting rod coaxially attached to said first upright opposite to said crossmember; a second mounting rod coaxially attached to said second upright opposite to said crossmember; a first sleeve capable of receiving said first mounting rod; a second sleeve capable of receiving said second mounting rod; an attachment means for securing said first sleeve and said second sleeve to a floor.

Yet another preferred embodiment is provided in an apparatus for use as a croquet stake comprising; a stake; a mounting rod coaxially attached to said stake; a sleeve capable of receiving said mounting rod; a means for securing said sleeve to a floor.

DETAILED DESCRIPTION OF THE INVENTION

Throughout the following description similar elements are numbered accordingly.

Figure 1:
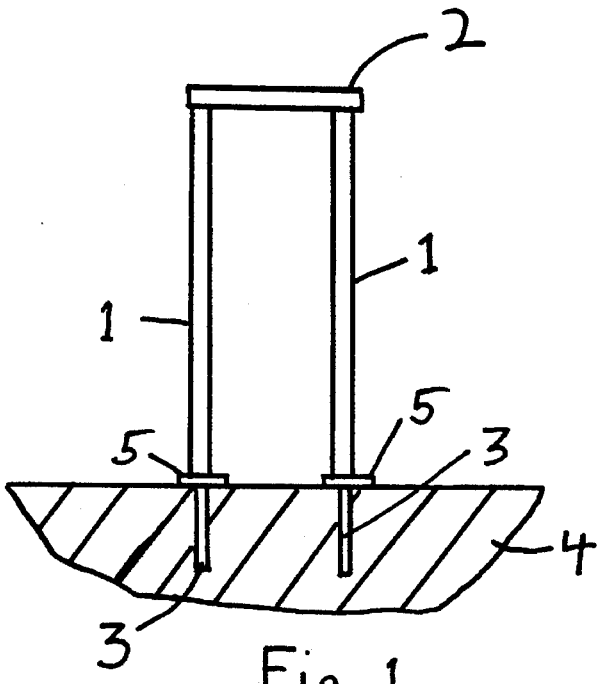
Fig. 1 Prior Art
FIG. 1 illustrates a prior art croquet wicket for outdoor use.

FIG. 1 shows one type of conventional wicket for outdoor use wherein co-planar posts, 1, are joined by a crossmember, 2. The lower portion of the wicket comprises a pair of spikes, 3, which are inserted into the ground, 4, such that the flange, 5, touches the playing surface.

Figure 2:
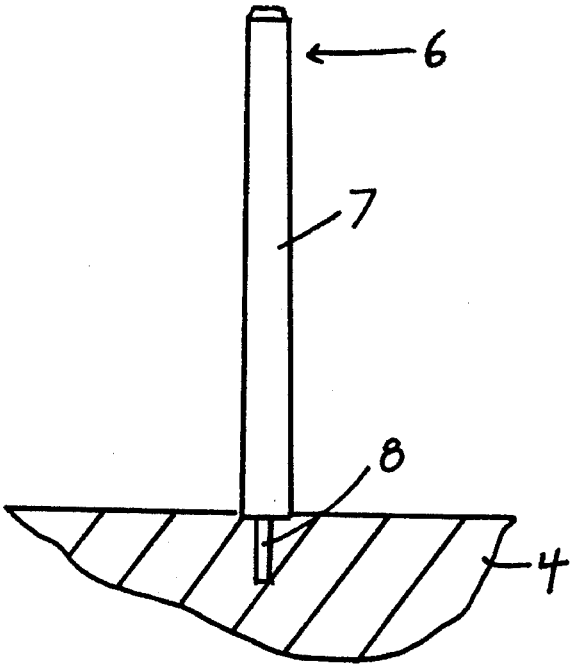
Fig. 2 Prior Art
FIG. 2 illustrates a prior art croquet stake for outdoor use.

FIG. 2 shows a prior art stake as commonly used in outdoor croquet. The stake, 6, comprises a striker portion, 7, which is struck by the ball during play and is visible, and a submerged portion, 8, which is inserted into the ground, 4, for play.

Figure 3:
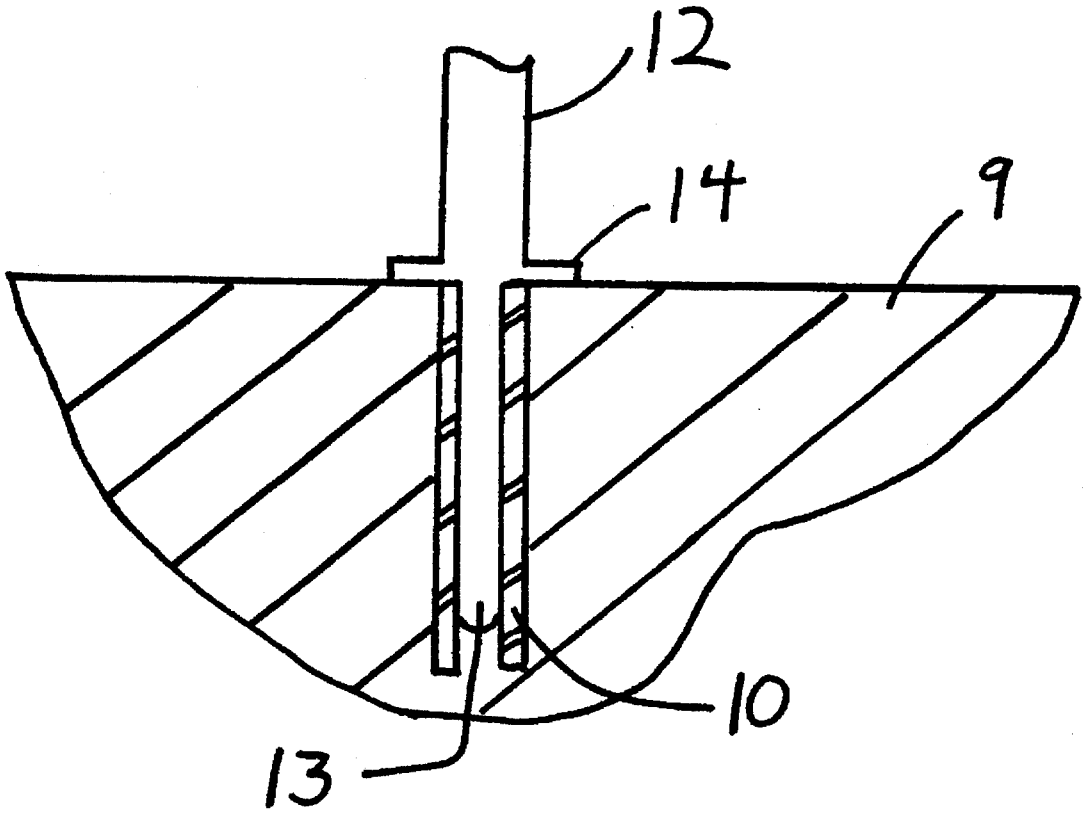
FIG. 3, is a cross-sectional view of an embodiment of the inventive croquet apparatus mounting system.

FIG. 3 shows a cross-sectional view of one embodiment of the inventive croquet mounting system. In FIG. 3 the floor, 9, comprises a void tightly fit with a sleeve, 10. The croquet apparatus supports, 11, comprise an upper portion, 12, and a lower portion, 13. The lower portion, 13, tightly, and reversibly fits into the sleeve, 10, for play. The croquet apparatus support optionally, but preferably, comprises a flange, 14. When play is complete the croquet apparatus support, 11, is persuaded upwards thereby disengaging the lower portion, 13, from the sleeve, 10. The croquet apparatus can then be removed from the location. It would be apparent that the sleeve remains in the void of the floor for reinsertion of the lower portion of the croquet apparatus support as necessary. The croquet apparatus support, 11, may represent a stake, or taken in tandem a suitably arranged pair of croquet apparatus supports may represent a pair of wicket uprights. The sleeve is preferably permanently inserted into the void of the floor, 9, by any of a myriad of methods known in the art.

Figure 4:
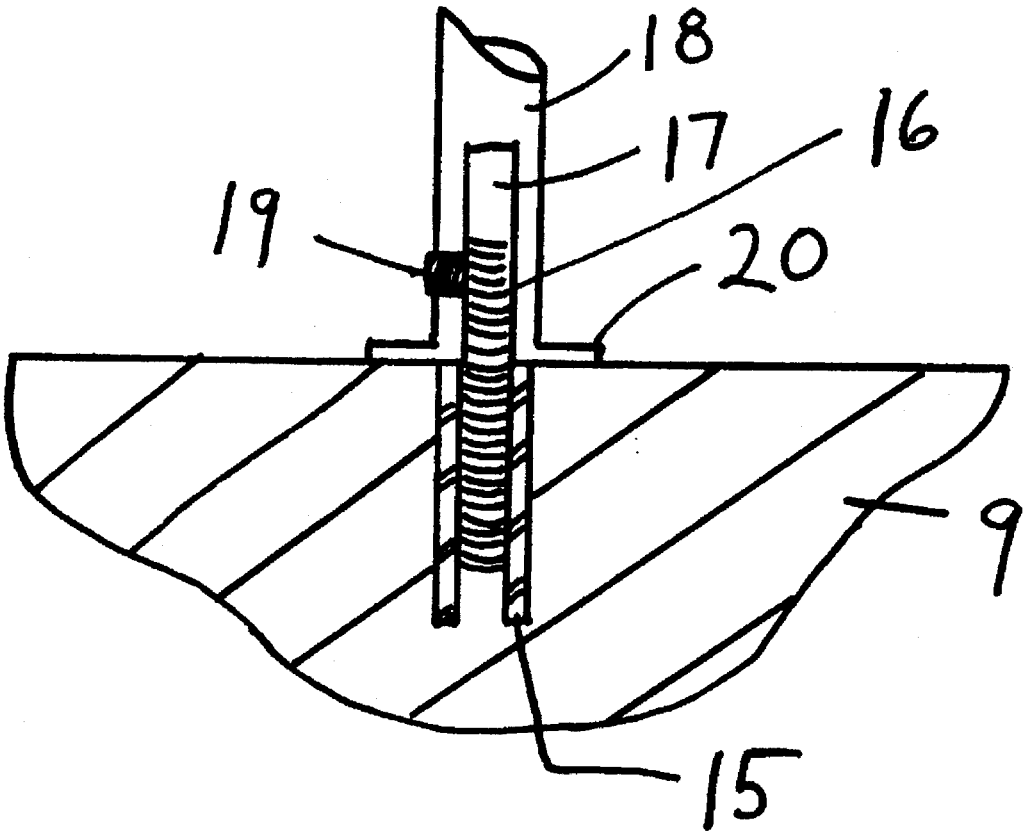
FIG. 4 is a cross-sectional view of another embodiment of the inventive croquet apparatus mounting system.

FIG. 4 illustrates a cross-sectional view of an embodiment of the present invention wherein the floor, 9, comprises a void fit with an internally threaded sleeve, 15. A similarly threaded stud, 16, is reversibly inserted into the internally threaded sleeve, 15, such that a portion protrudes above the surface of the floor. The internally threaded sleeve, 15, is received in a void, 17, of the apparatus support, 18. An optional, but preferred, set screw, 19, reversibly engages the. threaded stud as common in the art. To remove the apparatus support from the location the set screw, if included, is disengaged from the threaded stud and the apparatus support is pursuaded away the floor. The threaded stud is then removed from the internally threaded sleeve. To reinstall the apparatus the removal process is reversed as Would be apparent to one skilled in the art. The apparatus support may comprise an optional, but preferred, flange, 20, to rest on the surface of the floor, 9.

Figure 5:
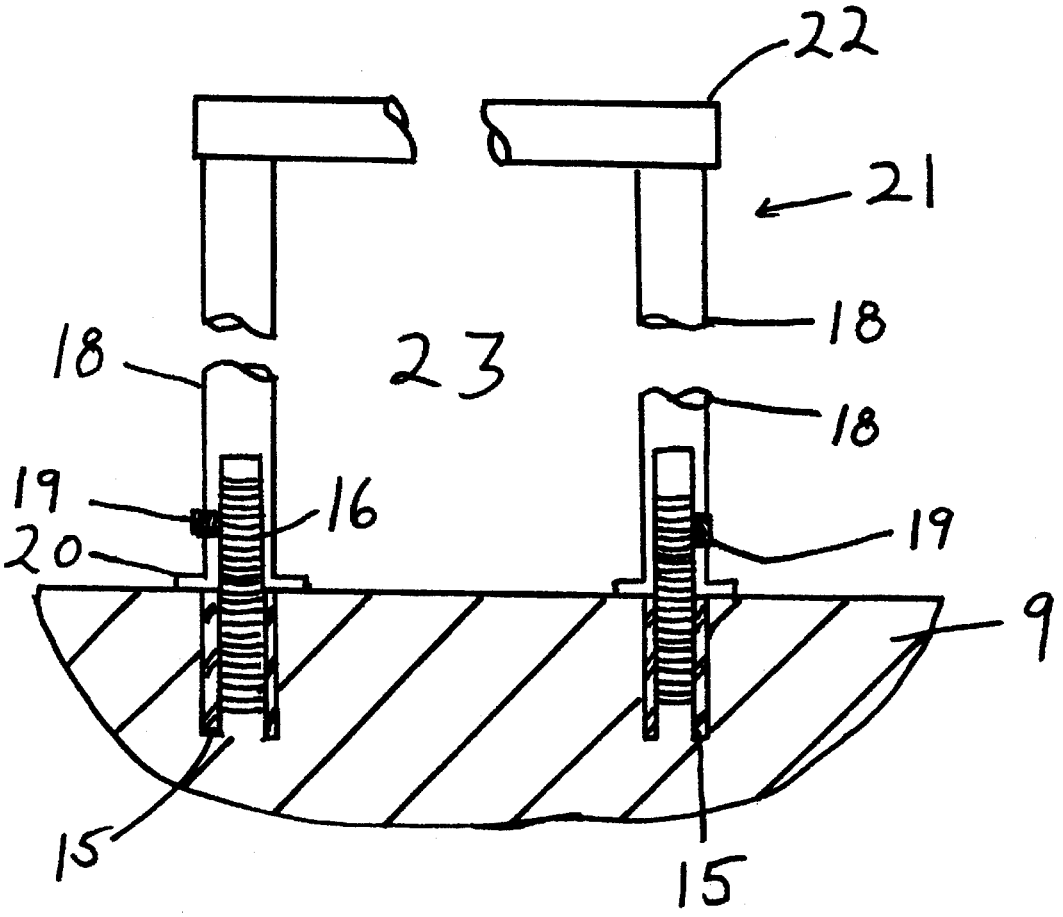
FIG. 5 is a cross-sectional view of an inventive croquet wicket wherein the apparatus mounting system of FIG. 4 is utilized.

FIG. 5 illustrates a cross-sectional view of an inventive croquet wicket. In FIG. 5 a pair of internally threaded sleeves, 15, are secured within a void of the floor, 9. A pair of threaded studs, 16, are rotationally secured within the internally threaded sleeves, 15. The pair of apparatus supports, 18, form the uprights of the wicket, 21. The pair of apparatus supports, 18, are connected at the upper extent by a crossmember, 22. In accordance with the rules of proper croquet the ball transits the tunnel, 23, defined as the area bound by the surface of the floor, the pair of support apparatus and the crossmember. The set screw, 19, and flange, 20, are described above.

Figure 6:
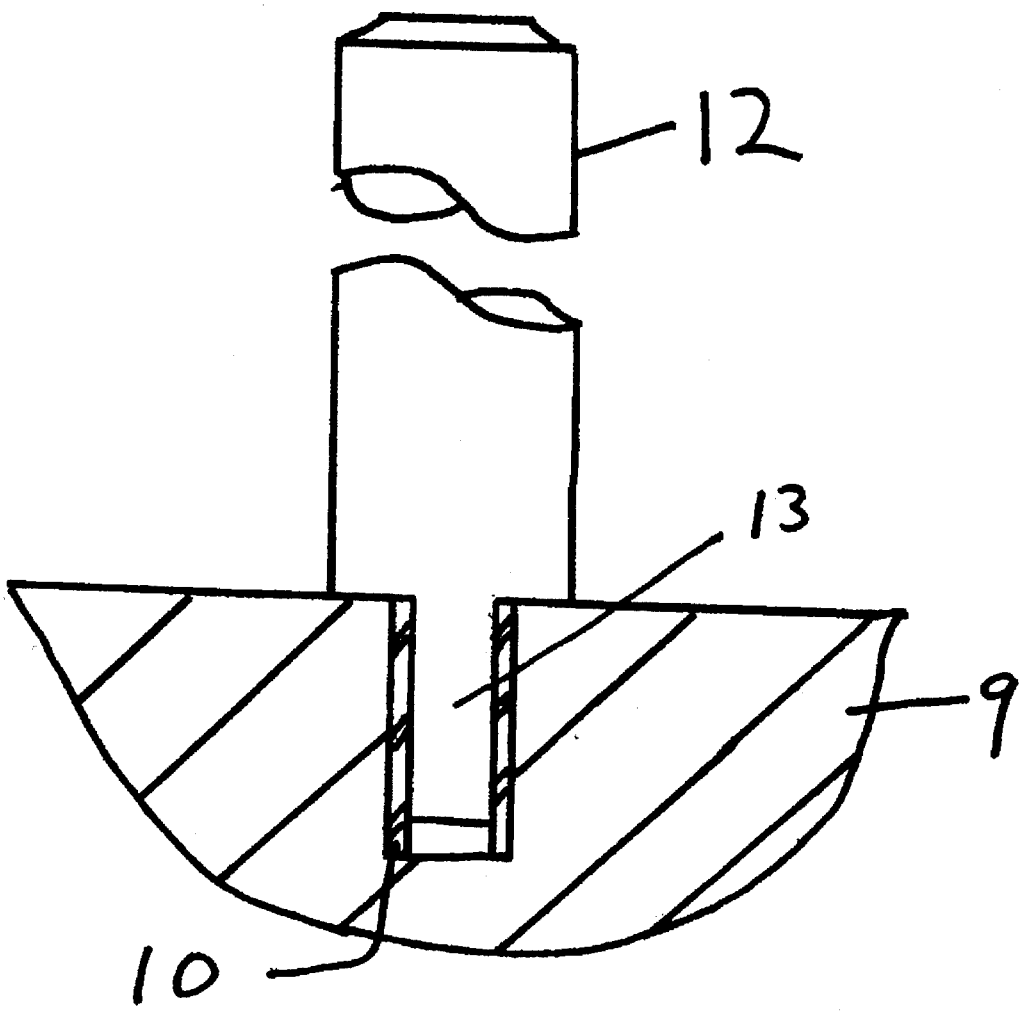
FIG. 6 is a cross-sectional view of an inventive croquet stake wherein the apparatus mounting system of FIG. 3 is utilized.

FIG. 6 illustrates a cross-sectional view of the croquet apparatus mounting method illustrated in FIG. 3 as applied to an inventive stake. A sleeve, 10, is securely attached to the void the floor, 9. The lower portion, 13, reversibly fits within the sleeve, 10. The upper portion, 12, represents the stake.

Figure 7:
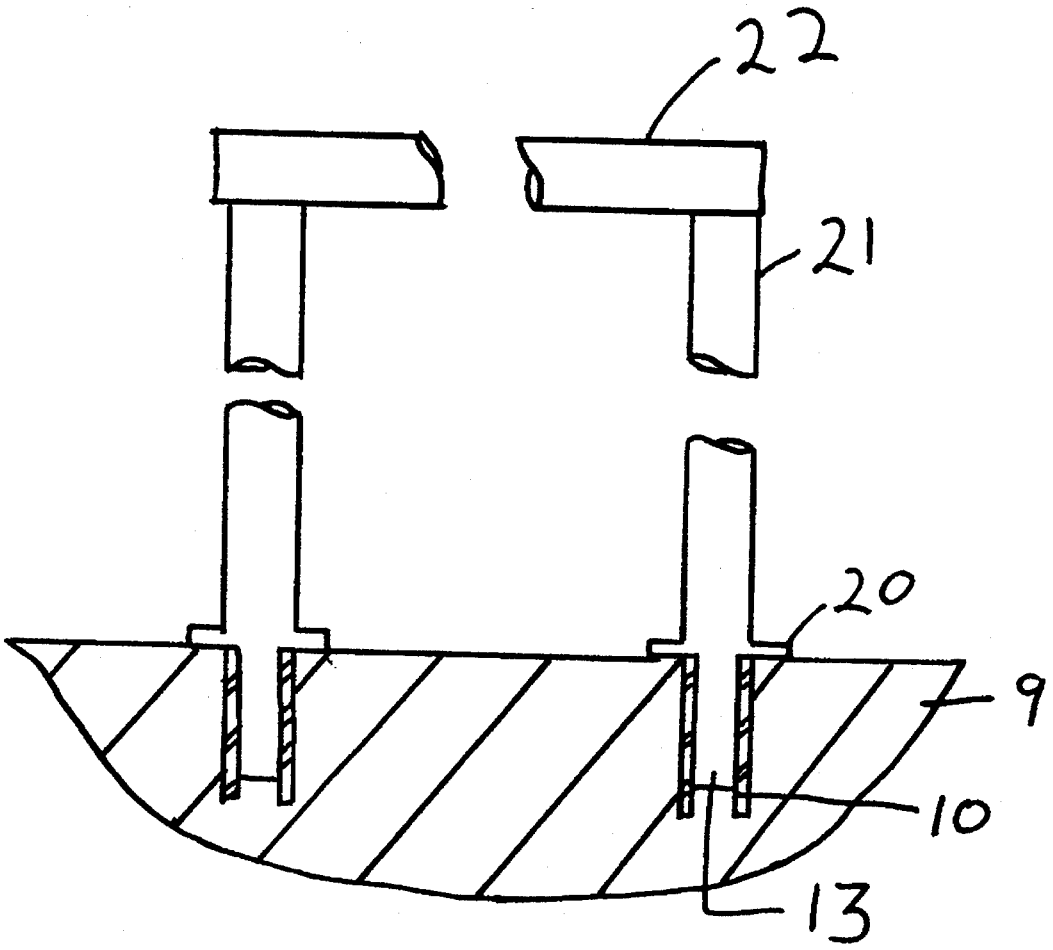
FIG. 7 is a cross-sectional view of an inventive croquet wicket wherein the apparatus mounting system of FIG 3 is utilized.

FIG. 7 illustrates an inventive wicket of the present invention wherein the floor, 9, sleeve, 10, lower support, 13, flange, 14, wicket, 21, and crossmember, 22, are as described for FIGS. 3 and 5 above. The lower support is preferably rigidly attached to the wicket. Attachment may be by mating threads, as commonly employed in a nut and bolt arrangement, by welding or any other method common in the art for coaxially joining two elements.

Figure 8:
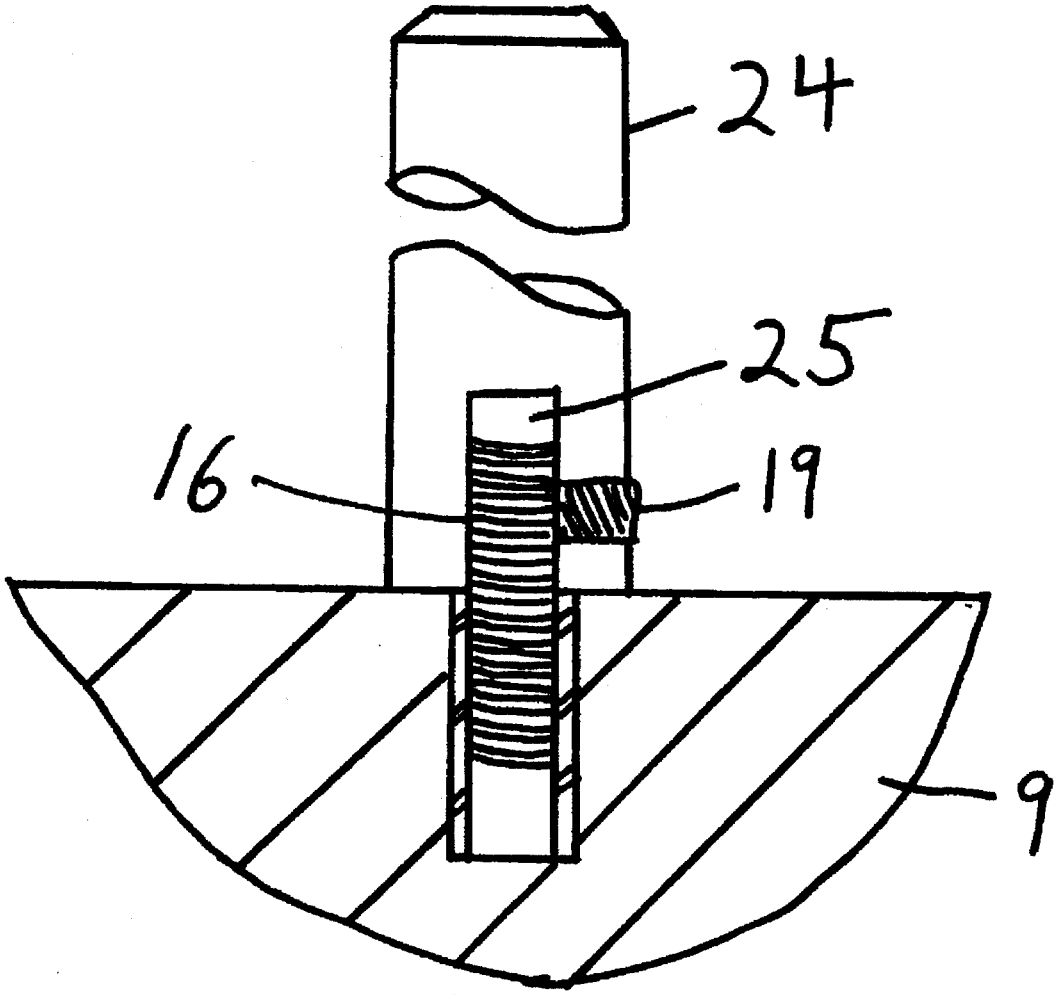
FIG. 8 is a cross-sectional view of an inventive croquet stake wherein the apparatus mounting system of FIG. 4 is utilized.

FIG. 8 illustrates an inventive stake, 24, of the present invention wherein the threaded stud, 16 is received within a void, 25. The void may comprise threads or an internally threaded sleeve for rotationally mating with the threaded stud. The floor, 9, internally threaded sleeve, 15, and optional set screw, 19, are as represented in FIG. 4.

Croquet wickets of the present invention are substantial replicates of conventional wickets in size, color and spacing. The wicket uprights are coplanar and preferably parallel. Any common material is suitable for manufacture including wood, metal, or synthetic material such as plastic and the like. Preferably the uprights are constructed of metal. The crossmember is typically manufactured from the same material as the uprights although the invention is not limited by the material of construction. The width of the wicket is measured between the uprights and is chosen for the skill level and local rules of play. The width of the wicket is preferably at least approximately 2 inches and no more than approximately 8 inches. For proper croquet the inside measurement between the uprights is preferably not less than approximately 3.6875 inches nor more than approximately 4 inches. Most preferred is a wicket width of no more than approximately 3.75 inches and no more than approximately 4 inches. The height of the wicket, as measured from the playing surface to the top of the wicket, is preferably between approximately 11 inches and approximately 13 inches and most preferably the height is approximately 12 inches. The wicket uprights are preferably approximately 0.625 inches in diameter.

The croquet stake of the present invention is substantially a replicate of conventional croquet stakes in size and color. Any common material is suitable for manufacture including wood, metal, or synthetic material such as plastic and the like. The preferred material of manufacture is wood. The height and diameter of the stake is chosen based on skill level and local rules of play. The height is preferably at least approximately 6 inches in height and no more than approximately 30 inches in height. More preferred is a height of approximately 16 to approximately 20 inches in height and most preferred is approximately 17.5 to approximately 18.5 inches. The diameter of the stake is preferably approximately 1 inch to approximately 2 inches and most preferably approximately 1.25 to approximately 1.75 inches.

The inventive croquet mounting system is inserted into a void in the playing surface. The void is preferably round and of a suitable size to accept the sleeve and any material necessary to secure the sleeve such as epoxy and the like. The void can be obtained by drilling or prefabricated into the material. The void may threaded with a matching thread on the exterior of the sleeve.

The sleeve is preferably a steel tube of adequate size. A tube with an inside diameter of approximately 0.125 inches to approximately 1.0 inches is eminently suitable for use in the present invention. A tube with an outside diameter of approximately 0.625 inch and an inside diameter of approximately 0.3125 inches has been determined to be suitable in the present invention. The interior of the sleeve may be threaded in accordance with an embodiment of the present invention or it may be smooth. A polygon sleeve may be mentioned such as triangular, square, pentagonal, hexagonal and the like. Most preferred is a round sleeve. The sleeve is preferably securely attached to the floor with threads, epoxy, glue, or the like or the exterior dimension of the sleeve and the interior dimension of the void may be such that the sleeve is tightly inserted. The length of the sleeve is chosen for convenience and strength. The sleeve is preferably at least approximately 0.5 inches long and preferably no more than approximately 6 inches long. The lower portion of the inventive apparatus may be the same length as the sleeve or preferably less. The threaded stud is preferably longer than the sleeve to insure a sufficient length of stud is engaged with the sleeve for strength and a sufficient amount is above the floor for attaching the apparatus.

The threaded stud is preferably steel. A preferred diameter is approximately 0.125 to approximately 1 inch. A stud with a diameter of approximately 0.625 inches has been determined to be suitable for the present invention.

Contemplated is a plug which replaces the croquet apparatus for reversibly filling the sleeve when the croquet apparatus is not installed.

The optional, but preferred, flange is of a suitable size to lend support for the apparatus without interfering with the travel of the ball during play. A flange diameter of approximately 1 inch to approximately 2 inches is suitable for use in proper croquet.

The crossmember may be perpendicular to each upright or the uprights may be joined by an arch, or other structures as known in the art.

The description of the invention has been adequately described for use in the game of croquet and the various embodiments have been defined utilizing the common nomenclature of American Croquet. It is within the scope and intent of the present invention to include related games wherein the apparatus claimed may be employed.

I claim:

1. A croquet apparatus mounting system comprising;

an apparatus support;

a threaded stud coaxially attached to one side of said apparatus support;

an internally threaded sleeve capable of receiving said threaded stud;

an attachment means for securing said threaded sleeve within a void of a floor.

2. The croquet apparatus mounting system recited in claim 1 wherein said stud is detachable from said apparatus support.

3. The croquet apparatus mounting system recited in claim 1 wherein said stud and said apparatus support are constructed of metal.

4. The croquet apparatus mounting system recited in claim 1 wherein said apparatus support is wooden.

5. The croquet apparatus mounting system recited in claim 1 wherein said apparatus support is a croquet stake with a height of at least 16 inches to no more than 20 inches and a diameter of at least 1 inch to no more than 2 inches.

6. The croquet apparatus mounting system recited in claim 1 further comprising a flange to rest on the surface of said floor.

7. The croquet apparatus mounting system recited in claim 1 further comprising a set screw in said apparatus support capable of reversibly engaging with said threaded stud.

8. The croquet apparatus mounting system recited in claim 1 wherein said apparatus support is at least 6 inches in height and no more than 30 inches in height.

9. The croquet apparatus mounting system recited in claim 8 wherein said apparatus support is at least 16 inches in height and no more than 20 inches in height.

10. The croquet apparatus mounting system recited in claim 1 wherein said apparatus support is at least 1 inch in diameter and no more than 2 inches in diameter.

11. The croquet apparatus mounting system recited in claim 1 further comprising a plug for reversibly filling said sleeve.

12. The croquet apparatus mounting system recited in claim 11 wherein said first apparatus support and said second apparatus support are at least 2 inches apart and no more than 8 inches apart.

13. The croquet apparatus mounting system recited in claim 1 comprising:

a first apparatus support;

a first threaded stud coaxially attached to one side of said first apparatus support;

a first internally threaded sleeve capable of receiving said first threaded stud;

a first attachment means for securing said first threaded sleeve within a void of a floor;

a second apparatus support;

a second threaded stud coaxially attached to one side of said second apparatus support;

a second internally threaded sleeve capable of receiving said second threaded stud;

a second attachment means for securing said second threaded sleeve within a void of a floor;

a crossmember connecting said first apparatus support and said second apparatus support.

* * * * *